US006293975B1

(12) United States Patent
Scalliet et al.

(10) Patent No.: US 6,293,975 B1
(45) **Date of Patent: *Sep. 25, 2001**

(54) FUEL COMPOSITION

(75) Inventors: Robert M. Scalliet, Houston; Raymond R. Ruth, Pearland, both of TX (US)

(73) Assignee: US Filter Corporation, Lowell, MA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/124,689

(22) Filed: Jul. 29, 1998

Related U.S. Application Data

(63) Continuation of application No. 07/924,828, filed on Aug. 4, 1992, now Pat. No. 5,788,721.

(51) Int. Cl.[7] ..... C10L 1/10
(52) U.S. Cl. ..... 44/281
(58) Field of Search ..... 44/281, 282, 300, 44/311

(56) References Cited

U.S. PATENT DOCUMENTS

| | | | | |
|---|---|---|---|---|
| 4,358,292 | * | 11/1982 | Battista | 44/281 |
| 4,686,049 | * | 8/1987 | Klobenzer et al. | 210/774 |
| 4,810,393 | * | 3/1989 | Guinard | 210/774 |
| 4,842,616 | * | 6/1989 | Verhille | 44/281 |
| 4,931,176 | * | 6/1990 | Gainard | 210/179 |
| 4,983,296 | * | 1/1991 | McMahon et al. | 44/605 |
| 5,141,526 | * | 8/1992 | Chu | 44/605 |
| 5,439,489 | * | 8/1995 | Scalliet et al. | 44/281 |
| 5,788,721 | * | 8/1998 | Scalliet et al. | 44/281 |

* cited by examiner

*Primary Examiner*—Margaret Medley
(74) *Attorney, Agent, or Firm*—Conley, Rose & Tayon, P.C.

(57) ABSTRACT

A composition for use as a fuel comprising: less than about 10% by weight water; greater than about 35% by weight solids and from about 30 to about 65% by weight of liquid hydrocarbons; the solids comprising inorganic solids and combustible organic solids that are insoluble in methylene chloride and the composition having a minimum heat value of at least about 7,000 BTU/lb. and a viscosity such that the composition is a pumpable fluid at ambient temperature. The solids and the liquid hydrocarbons are obtained from a single refinery waste stream containing liquid hydrocarbons, water and said solids so that all of the heat value of the composition is derived from components initially present in the waste stream.

21 Claims, No Drawings

FUEL COMPOSITION

This application is a continuation of copending application(s) Ser. No. 07/924,828 filed on Aug. 4, 1992 now U.S. Pat. No. 5,788,721.

FIELD OF THE INVENTION

The present invention relates to a fuel composition. More particularly, the present invention relates to a fuel composition derived from a waste stream, particularly a petroleum refinery waste stream.

BACKGROUND OF THE INVENTION

Waste product streams containing primarily water, and smaller amounts of nonaqueous liquids and solids, both organic and inorganic, are by-products of the refining, petrochemical and chemical industries, to name a few. For example, a typical waste stream from a refinery operation will contain about 80 percent-by-weight water, about 15 percent-by-weight oil, e.g., hydrocarbons and other non-aqueous liquids, and about 5 percent-by-weight solids. Due to environmental regulations, these waste stream pose disposal problems.

It is known to treat a refinery waste stream, commonly referred to as sludge which is a mixture of solids, water and oil products, in such a manner to obtain either a solids stream which is a slurry of solids, both inorganic and organic, in a primarily aqueous medium, the slurry generally containing from about 15 to about 20 percent-by-weight solids content, or a non-pumpable dry solids cake. Such slurries, containing a relatively small amount, i.e., less than about 10 percent-by-weight, of nonaqueous liquids, e.g., hydrocarbons, can be incinerated as for example, in furnaces used in regenerative spent sulfuric acid plants, cement kilns or the like. These prior art aqueous slurries have several disadvantages. For one, because of the high water content, they have a low heat value. Additionally, the solids content of the slurries cannot exceed about 20–25 percent lest they become so viscous as to be unpumpable at ambient temperature conditions. Accordingly, the cost of disposing of the slurries is increased because the transportation costs per unit weight of solids is relatively high. In the case of non-pumpable, dry solids cake, the solids content is generally 25 to 90 percent-by-weight. This cake requires special handling for disposal and is considerably more expensive than the slurries to dispose of.

SUMMARY OF THE INVENTION

It is therefore an object of the present invention to provide a new fuel composition which is pumpable.

Another object of the present invention is to provide a pumpable fuel composition derived from a waste stream containing water, nonaqueous liquids, inorganic solids and organic solids.

Still a further object of the present invention is to provide a pumpable fuel composition of a relatively high solids content which can be disposed of more economically.

The above and other objects of the present invention will become apparent from the description given herein and the claims.

The present invention provides a fuel composition comprising less than about 10 percent-by-weight water, greater than about 35 percent-by-weight solids, generally up to about 70 percent-by-weight solids, and from about 30 to about 70 percent-by-weight of a nonaqueous liquid. The fuel composition has a minimum heat value of about 7000 BTU per pound and a viscosity such that the composition is pumpable at ambient temperature.

DESCRIPTION OF THE PREFERRED EMBODIMENT

The fuel composition of the present invention comprises water, solids and nonaqueous, generally water-insoluble liquids. Generally speaking, the water will be present in an amount of less than about 10 percent-by-weight, more preferably in the range of from about 3 to about 8 percent-by-weight. The solids, which can include both inorganic and organic containing materials, will comprise greater than about 35 percent-by-weight, generally up to about 70 percent-by-weight, the solids generally comprising from about 12 to about 30 percent-by-weight inorganic solids and from about 12 to about 30 percent-by-weight organic solids. The organic solids are carbon-containing are substantially methylene chloride insoluble but because of their carbon content are usually combustible. In certain cases the solids content can be substantially all organic, i.e., carbon-containing, or all inorganic. The nonaqueous liquids will generally comprise from about 30 to about 70 percent-by-weight of the fuel composition. The nonaqueous liquid can be virtually any combustible organic material which is insoluble or has limited solubility in water. Non-limiting examples of suitable nonaqueous liquids include hydrocarbons, alcohols, ketones, ethers, aldehydes, etc., as well as mixtures of such compounds. Typically, the non-aqueous liquid is referred to as "oil.". As used herein, oil refers to any mixture of organic compounds typically found in waste streams or sludges in refineries petrochemical plants and the like which are generally immiscible with water. While such oils primarily comprise hydrocarbons, other organic compounds can also be present.

The fuel compositions of the present invention can also include dispersant and/or surfactants such as lignosulfonates.

The fuel composition will have a minimum heat capacity of at least about 7000 BTU per pound, preferably greater than about 10,000 BTU per pound.

The fuel composition of the present invention, because it has a relatively high content of liquids which are less polar than water, does not become viscous rendering it unpumpable at ambient temperature. Prior art slurries used for fuel in furnaces or cement kilns suffer from the disadvantage that, because the water content is high, the solids content must be kept below about 25 percent-by-weight in order that the slurry can be handled by conventional pumps. As can be seen, the fuel composition of the present invention contains a minimum of about 35 percent-by-weight solids and can contain about up to 70 percent-by-weight solids and still be pumpable. This high solids loading is further advantageous in that transportation and disposal costs per unit weight of solids is reduced.

In the disposal of a typical waste stream, e.g., a refinery waste stream, EPA regulations and Boiler and Industrial Rules (BIF) permit the waste stream (sludge) to be incinerated, as for example in cement kilns, furnaces in spent sulfuric acid regeneration plants and the like, provided that the combustible solids plus any nonaqueous liquids present in the original waste stream have a minimum heat value of at least about 5000 BTU per pound. Thus, if the solids stream recovered from a typical refinery waste stream, which generally, primarily contains water, has a minimum heat value of at least 5000 BTU per pound, such a solids stream can be incinerated in the manner mentioned above.

Alternately, if oil or other nonaqueous liquids recovered from the waste stream are added back to the solids stream recovered from the waste stream, and the mixture of the recovered solids stream and added back nonaqueous stream has a minimum heat capacity of at least 5000 BTU per pound, the mixture can also be incinerated as described.

As noted above, the composition of the present invention can be derived from refinery waste streams. Such streams can include, for example, AP1 separator sludge, dissolved air floatation float, slop oil emulsion solids, tank bottoms (leaded) heat exchanger bundle cleaning sludge, oily waste sludges from the refinery's primary side of the waste water treatment system and oily tank bottom sludges. However, the source or feed stream for the composition need not be a waste stream from a refinery. For example, in numerous petrochemical and chemical operations, waste streams, primarily aqueous in nature, are produced which pose the same or similar disposal problems in that they contain hazardous solids and nonaqueous liquids. Thus, the composition of the present invention can be derived from an), waste stream, regardless of source, which contains a liquid, nonaqueous fraction, a solids fraction and an aqueous fraction.

A typical waste stream which can be used as the source of the composition of the present invention will generally contain from about 5 to about 30 percent-by-weight water-insoluble, nonaqueous liquids, from about 50 to about 95 percent-by-weight water and from about 1 to about 10 percent-by-w,eight solids. For example, a typical refinery waste stream will generally contain from about 10 to about 20 percent-by-weight nonaqueous liquids, from about 60 to about 90 percent-by-weight water and from about 2 to about 8 percent-by-weight solids.

If the composition of the present invention is to be derived from a waste stream such as a refinery sludge, it is convenient to separate the waste stream by using one or more well-known techniques such as, for example, distillation, extraction, decantation, centrifugation, filtration, etc. However, it is more convenient to effect separation of the waste stream as per the techniques and using apparatus disclosed in U.S. Pat. Nos. 4,810,393 and 4,931,176, both of which are incorporated herein by reference for all purposes. Using the processes and apparatus disclosed in the aforementioned patents, a typical waste stream, i.e., a refinery sludge containing about 80 percent-by-weight water, about 15 percent-by-weight oil and about 5 percent-by-weight solids, can be separated into an oil stream containing about 98 percent-by-weight oil, about 1 percent-by-weight water and about 1 percent-by-weight solids, a water stream containing about 98 percent-by-weight water, about 1 percent-by-weight oil and about 1 percent-by-weight solids, and a solids stream containing about 90 percent-by-weight water, about 1 percent-by-weight oil and about 9 percent-by-weight solids. Thus, there is provided a source for the three components of the composition.

Any number of nonaqueous liquids can be employed to form the fuel slurry. Indeed, virtually any combustible organic material mentioned above used to form the fuel compositions of the present invention can be employed. For example, the nonaqueous liquid can conveniently comprise the nonaqueous stream recovered from the waste stream.

To more fully illustrate the present invention, the following non-limiting examples are presented.

EXAMPLE 1

A typical refinery waste stream was separated into an aqueous stream, an oil stream and a solids stream. The solids stream was dried mechanically to produce a de-watered solids stream that contained about 59 percent-by-weight water, about 36 percent-by-weight solids and about 5 percent weight oil. The de-watered solids stream was then thermally dried to remove water and obtain a composition containing about 4 percent-by-weight water, about 84.3 percent-by-weight solids and about 11.7 percent-by-weight oil. The solids were later found to comprise about 10.95 percent-by-weight ash and about 35.05 percent-by-weight non-methylene chloride extractable organic solids, i.e, combustible solids. To the dried solids composition was added oil which had been separated from the waste stream to produce a fuel composition which contained about 8 percent-by-weight water, about 46 percent-by-weight solids and about 46 percent-by-weight oil. The fuel composition had a viscosity of 52 cps at 80° F. as measured by a Brookfield viscometer. The fuel composition had a heat content of 13,463 BTU per pound and was pumpable at ambient temperature.

EXAMPLE 2

A typical refinery waste stream was separated into an oil stream, a clean water stream and a solids stream that was 5 to 8 percent solids by weight. The solids stream was de-watered mechanically to produce a cake containing 54. 1 percent-by-weight water, 32.5 percent-by-weight solids and 13.3 percent-by-w eight oil. The de-watered cake was mixed with oil from the oil stream, forming a wet slurry. This wet slurry was transferred to a heating vessel and the temperature increased until boiling occurred. Boiling was continued until enough water was removed from the batch to yield a fuel having the following composition: 5 percent-by-weight water, 35 percent-by-weight solids and 60 percent-by-weight oil. The fuel composition had a viscosity of 1500 cps at 80° F. measured using a Brookfield Viscometer. The fuel had a heat value of 13,000 BTU-per pound.

What is claimed is:

1. A fuel composition, comprising:

water;

greater than about 35% by weight solids, said solids comprising inorganic solids and combustible organic solids that are insoluble in methylene chloride; and at least about 30% by weight of liquid hydrocarbons;

the composition having a minimum heat value of at least about 7,000 BTU/lb and viscosity such that said composition is a pumpable fluid at ambient temperature, said solids and said liquid hydrocarbons being obtained from the same refinery waste stream containing liquid hydrocarbons, water and said solids whereby all of the heat value of the composition is derived from components initially present in said waste stream;

with the proviso that no more than about ten percent by weight of water is present.

2. The composition of claim 1 wherein the composition has a minimum heat value of at least about 10,000 Btu/lb.

3. A fuel composition, comprising:

less than about 10% down to about 3% by weight water;

greater than about 35% by weight solids, said solids comprising inorganic solids and combustible organic solids that are insoluble in methylene chloride;

at least about about 30% by weight of liquid hydrocarbons;

the composition having a minimum heat value of at least about 7,000 BTU/lb. and viscosity such that said composition is a pumpable fluid at ambient temperature, said solids and said liquid hydrocarbons being obtained from the same refinery waste stream containing liquid hydrocarbons, water and said solids whereby all of the heat value of said composition is derived from components initially present in said waste stream.

4. The composition of claim 3 wherein the composition has a minimum heat value of at least about 10,000 Btu/lb.

5. A fuel composition derived from a waste stream, consisting essentially of:

water;

greater than about 35% by weight solids, said solids being obtained from a refinery waste stream containing liquid hydrocarbons, water and solids, such that at least about 12 percent by weight of the fuel composition comprises inorganic solids; and at least about 30% by weight of liquid hydrocarbons;

the composition having a minimum heat value of at least about 7,000 BTU/lb. and having a viscosity wherein the composition is a pumpable fluid at ambient temperature;

with the proviso that no more than about ten percent by weight of water is present.

6. The composition of claim 5 wherein a portion of the heat value of the composition is derived from the liquid hydrocarbons initially present in the same refinery waste stream as said solids and a portion of the heat value of the composition is derived from liquid hydrocarbons initially present in a waste stream of a different source.

7. The composition of claim 5 wherein said solids comprise from about 12 to about 30 percent by weight inorganic solids.

8. The composition of claim 5 wherein said solids in said fuel composition further include from about 12 to about 30 percent by weight non-methylene chloride extractable organic solids.

9. The composition of claim 5 wherein said solids in said fuel composition are substantially inorganic.

10. The composition of claim 5 wherein said solids in said fuel composition are derived from API separator sludge.

11. The composition of claim 5 wherein said solids in said fuel composition are derived from dissolved air floatation float.

12. The composition of claim 5 wherein said solids in said fuel composition are derived from slop oil emulsion solids.

13. The composition of claim 5 wherein said solids in said fuel composition are derived from tank bottoms.

14. The composition of claim 5 wherein said solids in said fuel composition are derived from heat exchanger bundle cleaning sludge.

15. The composition of claim 5 wherein the composition has a minimum heat value of at least about 10,000 Btu/lb.

16. The composition of claim 5 wherein the pumpable composition includes approximately 46% by weight solids.

17. The composition of claim 5 wherein the pumpable composition includes approximately 5% by weight water.

18. The composition of claim 5 wherein said liquid hydrocarbons are obtained from a waste stream that is different from the said refinery waste stream of said solids.

19. A fuel composition derived from a waste stream, consisting essentially of:

water;

greater than about 35% by weight solids from the waste stream; and liquid hydrocarbons from a waste stream;

the composition having a minimum heat value of at least about 7,000 BTU/lb. and a viscosity wherein said composition is pumpable at ambient temperature;

with the proviso that no more than about ten percent by weight of water is present.

20. The fuel composition of claim 19 wherein the solids include inorganic solids.

21. The fuel composition of claim 19 wherein the liquid hydrocarbons are from a waste stream that is different from said waste stream that is the source of said solids.

* * * * *